US007568297B2

(12) United States Patent
Pierson et al.

(10) Patent No.: US 7,568,297 B2
(45) Date of Patent: Aug. 4, 2009

(54) GRAIN DRYING AERATION SYSTEM

(75) Inventors: Ken Pierson, Lethbridge (CA); Brian Macdonald, Lethbridge (CA); John Penner, Lethbridge (CA)

(73) Assignee: Woodhaven Capital Corp. (CA)

( * ) Notice: Subject to any disclaimer, the term of this patent is extended or adjusted under 35 U.S.C. 154(b) by 272 days.

(21) Appl. No.: 11/401,210

(22) Filed: Apr. 10, 2006

(65) Prior Publication Data

US 2007/0234587 A1 Oct. 11, 2007

(51) Int. Cl.
*F26B 19/00* (2006.01)

(52) U.S. Cl. ..... 34/218; 34/233; 34/493; 34/232; 34/65; 34/68; 34/171; 34/174; 219/697; 423/659

(58) Field of Classification Search ..... 34/218, 34/233, 493, 232, 68, 65, 171, 174; 423/659; 219/697

See application file for complete search history.

(56) References Cited

U.S. PATENT DOCUMENTS

| | | | | | |
|---|---|---|---|---|---|
| 106,961 | A | * | 8/1870 | Raymond | 454/175 |
| 1,330,195 | A | * | 2/1920 | Kuhn | 34/233 |
| 1,384,047 | A | * | 7/1921 | Carter | 34/505 |
| 1,443,597 | A | * | 1/1923 | Schwede | 34/102 |
| 1,447,401 | A | * | 3/1923 | Alsop | 126/59.5 |
| 1,474,683 | A | * | 11/1923 | Morton | 454/182 |
| 1,521,773 | A | * | 1/1925 | Johnson | 34/138 |
| 1,679,099 | A | * | 7/1928 | Smith | 426/507 |
| 1,802,476 | A | * | 4/1931 | Peterson | 209/238 |
| 1,880,284 | A | * | 10/1932 | Schenk | 366/271 |
| 1,914,341 | A | * | 6/1933 | Larsen | 426/256 |
| 1,914,877 | A | * | 6/1933 | Wright | 422/225 |
| 1,972,050 | A | * | 8/1934 | Davis | 43/138 |
| 1,988,677 | A | * | 1/1935 | Arnold | 432/45 |
| 1,988,678 | A | * | 1/1935 | Arnold | 34/364 |
| 2,070,285 | A | * | 2/1937 | Lissauer et al. | 426/656 |
| 2,070,286 | A | * | 2/1937 | Lissauer et al. | 426/656 |
| 2,179,485 | A | * | 11/1939 | Avril | 366/181.2 |
| 2,183,274 | A | * | 12/1939 | Barnsdale | 34/545 |
| 2,241,654 | A | * | 5/1941 | Arnold | 426/311 |
| 2,262,190 | A | * | 11/1941 | Meade | 34/102 |
| 2,278,701 | A | * | 4/1942 | Karr | 134/61 |
| 2,342,528 | A | * | 2/1944 | Carbaugh | 414/269 |

(Continued)

FOREIGN PATENT DOCUMENTS

| | | |
|---|---|---|
| CA | 1 251 038 | 3/1989 |

OTHER PUBLICATIONS

Downloaded page from www.wheatlandbins.com regarding Wheatland Hopper Bottom Bins Grain Bins "Grain Guard Aeration" (1 page) Oct. 6, 2005.

(Continued)

*Primary Examiner*—Stephen M. Gravini
(74) *Attorney, Agent, or Firm*—McKee, Voorhees & Sease, P.L.C.

(57) ABSTRACT

An improved vertical aeration system is provided for a grain bin having a sloped hopper bottom with a discharge opening. A pyramid frame includes legs with lower ends attachable to the hopper bottom. Concave perforated walls are attached to the legs. Braces extending between the legs provide structural support for the walls. An air duct extends upwardly and centrally into the interior of the frame, to supply air into the aeration system for flow outwardly through the perforated walls.

21 Claims, 4 Drawing Sheets

U.S. PATENT DOCUMENTS

| | | | | | |
|---|---|---|---|---|---|
| 2,349,300 | A | * | 5/1944 | Olsen | 34/266 |
| 2,407,636 | A | * | 9/1946 | Engler et al. | 366/337 |
| 2,408,810 | A | * | 10/1946 | Puening | 241/17 |
| 2,410,851 | A | * | 11/1946 | Welty | 432/66 |
| 2,440,524 | A | * | 4/1948 | Rains | 209/10 |
| 2,497,703 | A | * | 2/1950 | Todd | 34/164 |
| 2,524,331 | A | * | 10/1950 | Rysdon | 454/179 |
| 2,526,994 | A | * | 10/1950 | Cariani | 34/167 |
| 2,560,141 | A | * | 7/1951 | Tipps | 454/181 |
| 2,561,442 | A | * | 7/1951 | Lyon, Jr. et al. | 34/353 |
| 2,565,663 | A | * | 8/1951 | Osterbur et al. | 34/580 |
| 2,571,555 | A | * | 10/1951 | Fernandes | 99/478 |
| 2,591,173 | A | * | 4/1952 | Marken | 34/174 |
| 2,617,351 | A | * | 11/1952 | Graham, Jr. et al. | 99/477 |
| 2,641,063 | A | * | 6/1953 | Greiman | 34/102 |
| 2,654,590 | A | * | 10/1953 | Molenaar | 432/69 |
| 2,703,936 | A | | 3/1955 | Hut | |
| 2,715,781 | A | * | 8/1955 | Sproul | 34/174 |
| 2,853,361 | A | * | 9/1958 | Bryk et al. | 34/364 |
| 2,858,620 | A | * | 11/1958 | Naylor | 34/575 |
| 2,865,110 | A | * | 12/1958 | Perkias | 34/86 |
| 2,897,602 | A | * | 8/1959 | Hines et al. | 34/63 |
| 2,929,154 | A | * | 3/1960 | Finnegan | 34/92 |
| 2,946,132 | A | * | 7/1960 | Armstrong | 34/170 |
| 2,991,559 | A | * | 7/1961 | Pierpoint | 34/572 |
| 3,000,107 | A | * | 9/1961 | Ryan | 34/102 |
| 3,037,297 | A | * | 6/1962 | Epperson | 34/102 |
| 3,044,182 | A | * | 7/1962 | Steffen | 34/557 |
| RE25,230 | E | * | 8/1962 | Pierpoint | 34/572 |
| 3,053,522 | A | * | 9/1962 | Applegate | 432/45 |
| 3,056,214 | A | * | 10/1962 | Andersen, Jr. | 34/530 |
| 3,057,080 | A | * | 10/1962 | Haddix | 34/174 |
| 3,129,073 | A | * | 4/1964 | Mathews | 34/575 |
| 3,166,384 | A | * | 1/1965 | Clute | 34/581 |
| 3,181,740 | A | * | 5/1965 | Andersen, Jr. | 222/503 |
| 3,189,460 | A | * | 6/1965 | Smith, Jr. | 426/467 |
| 3,254,430 | A | * | 6/1966 | Ausherman | 34/174 |
| 3,257,733 | A | * | 6/1966 | Ives et al. | 34/380 |
| 3,274,699 | A | * | 9/1966 | Naylor | 34/575 |
| 3,285,157 | A | * | 11/1966 | Smith, Jr. | 99/476 |
| 3,309,782 | A | * | 3/1967 | Ellis | 34/394 |
| 3,313,040 | A | * | 4/1967 | Mathews | 34/174 |
| 3,333,348 | A | * | 8/1967 | Ausherman et al. | 34/174 |
| 3,350,995 | A | * | 11/1967 | Jeru | 454/173 |
| 3,365,813 | A | * | 1/1968 | Collins et al. | 34/170 |
| 3,380,174 | A | * | 4/1968 | McClaren | 34/475 |
| 3,400,465 | A | * | 9/1968 | Von Stroh | 34/443 |
| 3,400,466 | A | * | 9/1968 | McClaren | 34/483 |
| 3,416,239 | A | * | 12/1968 | Louks | 34/211 |
| 3,435,540 | A | * | 4/1969 | Sanders, Jr. et al. | 34/174 |
| 3,449,840 | A | * | 6/1969 | Francis | 34/187 |
| 3,514,861 | A | * | 6/1970 | Satake | 34/505 |
| 3,524,264 | A | * | 8/1970 | Kucera | 34/432 |
| 3,559,299 | A | * | 2/1971 | Tyler | 34/428 |
| 3,589,027 | A | * | 6/1971 | Duzan et al. | 34/543 |
| 3,597,850 | A | * | 8/1971 | Jenkins | 34/361 |
| 3,634,949 | A | * | 1/1972 | Louks | 34/174 |
| 3,656,812 | A | * | 4/1972 | Steltz | 406/137 |
| 3,673,699 | A | * | 7/1972 | Buffington | 34/66 |
| 3,690,016 | A | * | 9/1972 | Walhof et al. | 34/174 |
| 3,701,670 | A | * | 10/1972 | Pierce | 99/358 |
| RE27,573 | E | * | 2/1973 | Kucera | 34/435 |
| 3,721,018 | A | * | 3/1973 | Brandt et al. | 34/168 |
| 3,736,667 | A | * | 6/1973 | McClaren | 34/551 |
| 3,745,669 | A | * | 7/1973 | Meiners | 34/187 |
| 3,755,917 | A | * | 9/1973 | Lambert, Jr. | 34/179 |
| 3,755,918 | A | * | 9/1973 | Parrot | 34/236 |
| 3,793,742 | A | * | 2/1974 | Rainville et al. | 34/586 |
| 3,817,696 | A | * | 6/1974 | Hereth | 432/15 |
| 3,824,705 | A | * | 7/1974 | Ives | 34/170 |
| 3,861,058 | A | * | 1/1975 | Whelan | 34/588 |
| 3,869,809 | A | * | 3/1975 | Keirn | 34/174 |
| 3,872,606 | A | * | 3/1975 | Kashul | 34/166 |
| 3,911,594 | A | * | 10/1975 | McIntire et al. | 34/102 |
| 3,913,242 | A | * | 10/1975 | Fackler et al. | 34/170 |
| 3,955,288 | A | * | 5/1976 | Keirn | 34/174 |
| 4,006,536 | A | * | 2/1977 | Meiners | 34/169 |
| 4,035,928 | A | * | 7/1977 | Sietmann et al. | 34/174 |
| 4,045,882 | A | * | 9/1977 | Buffington et al. | 34/171 |
| 4,050,164 | A | * | 9/1977 | Campbell | 34/182 |
| 4,053,991 | A | | 10/1977 | Steffen | |
| 4,085,520 | A | * | 4/1978 | Lambert, Jr. | 34/79 |
| 4,086,708 | A | * | 5/1978 | Westelaken | 34/65 |
| 4,114,289 | A | * | 9/1978 | Boulet | 34/173 |
| 4,125,945 | A | * | 11/1978 | Westelaken | 34/65 |
| 4,126,946 | A | * | 11/1978 | Buffington et al. | 34/395 |
| 4,144,655 | A | * | 3/1979 | Harris | 34/236 |
| 4,149,844 | A | * | 4/1979 | Noyes | 432/17 |
| 4,152,841 | A | * | 5/1979 | Westelaken | 34/167 |
| 4,159,580 | A | * | 7/1979 | Welch, Jr. | 34/168 |
| 4,209,918 | A | * | 7/1980 | Klein | 34/182 |
| 4,240,209 | A | * | 12/1980 | Cuthbertson et al. | 34/363 |
| 4,241,517 | A | * | 12/1980 | Carpenter | 34/79 |
| 4,249,891 | A | * | 2/1981 | Noyes et al. | 432/14 |
| 4,262,584 | A | | 4/1981 | Dunbar | |
| 4,268,971 | A | * | 5/1981 | Noyes et al. | 34/395 |
| 4,270,280 | A | * | 6/1981 | McClaren | 34/493 |
| 4,294,019 | A | * | 10/1981 | Seitmann | 34/65 |
| 4,308,669 | A | * | 1/1982 | Noyes et al. | 34/504 |
| 4,324,053 | A | * | 4/1982 | Carpenter | 34/236 |
| 4,337,584 | A | | 7/1982 | Johnson | |
| 4,382,723 | A | * | 5/1983 | Moller | 406/90 |
| 4,404,756 | A | * | 9/1983 | Noyes | 34/65 |
| 4,446,630 | A | | 5/1984 | Book | |
| 4,448,134 | A | * | 5/1984 | Foote | 110/245 |
| 4,509,273 | A | * | 4/1985 | Roisen | 34/86 |
| 4,520,714 | A | * | 6/1985 | Gullickson | 454/178 |
| 4,522,335 | A | | 6/1985 | Kallestad | |
| 4,558,523 | A | * | 12/1985 | Isbell et al. | 34/491 |
| 4,601,414 | A | * | 7/1986 | Lawson | 222/564 |
| 4,671,030 | A | * | 6/1987 | Krauss | 52/197 |
| 4,676,007 | A | * | 6/1987 | Good | 34/573 |
| 4,688,332 | A | | 8/1987 | Kallestad | |
| 4,702,019 | A | * | 10/1987 | Tsuruno et al. | 34/168 |
| 4,714,812 | A | * | 12/1987 | Haagensen et al. | 219/697 |
| 4,728,287 | A | * | 3/1988 | Niems | 432/69 |
| 4,750,273 | A | * | 6/1988 | Parkes et al. | 34/484 |
| 4,754,557 | A | | 7/1988 | Anderson | |
| 4,790,986 | A | * | 12/1988 | Kim et al. | 423/659 |
| 4,821,428 | A | * | 4/1989 | Good | 34/86 |
| RE33,086 | E | * | 10/1989 | Bru | 424/44 |
| 4,885,985 | A | | 12/1989 | Pollock | |
| 4,894,928 | A | * | 1/1990 | Bishop | 34/60 |
| 4,924,601 | A | | 5/1990 | Bercaw | |
| 4,930,229 | A | | 6/1990 | Moser | |
| 4,939,346 | A | * | 7/1990 | Bailey et al. | 219/388 |
| 5,019,994 | A | | 5/1991 | Rainville | |
| 5,108,713 | A | * | 4/1992 | Kim et al. | 422/145 |
| 5,129,164 | A | * | 7/1992 | Painter et al. | 34/181 |
| 5,210,962 | A | * | 5/1993 | Jones, Jr. | 34/168 |
| 5,263,896 | A | | 11/1993 | Carroll | |
| 5,443,539 | A | * | 8/1995 | Westelaken | 34/370 |
| 5,468,122 | A | * | 11/1995 | Van Fossen | 414/808 |
| 5,653,043 | A | * | 8/1997 | Bestwick et al. | 34/171 |
| 5,671,550 | A | * | 9/1997 | Westelaken | 34/167 |
| 5,860,221 | A | * | 1/1999 | Morrison et al. | 34/64 |
| 5,906,482 | A | * | 5/1999 | Tedman | 432/77 |
| 6,098,305 | A | * | 8/2000 | Watson et al. | 34/167 |
| 6,230,421 | B1 | * | 5/2001 | Reed et al. | 34/401 |
| 6,349,485 | B1 | | 2/2002 | Reed | |
| 6,530,160 | B1 | | 3/2003 | Gookins | |
| 6,944,967 | B1 | * | 9/2005 | Staples | 34/183 |
| 7,000,333 | B2 | * | 2/2006 | Yarem et al. | 34/380 |
| 7,178,262 | B2 | * | 2/2007 | Staples | 34/183 |

| | | | | |
|---|---|---|---|---|
| 7,404,262 | B2 * | 7/2008 | Jurkovich et al. | 34/381 |
| 7,434,332 | B2 * | 10/2008 | Morton et al. | 34/468 |
| 7,461,466 | B2 * | 12/2008 | Morton et al. | 34/469 |
| 2005/0155247 | A1 * | 7/2005 | Yarem et al. | 34/384 |
| 2006/0053653 | A1 * | 3/2006 | Staples | 34/443 |
| 2006/0130357 | A1 * | 6/2006 | Long | 34/389 |
| 2007/0169370 | A1 * | 7/2007 | Sukup | 34/166 |
| 2007/0193061 | A1 * | 8/2007 | Sul | 34/382 |
| 2007/0234587 | A1 * | 10/2007 | Pierson et al. | 34/168 |
| 2008/0000100 | A1 * | 1/2008 | Staples | 34/345 |
| 2008/0022547 | A1 * | 1/2008 | Shivvers | 34/333 |
| 2008/0201980 | A1 * | 8/2008 | Bullinger et al. | 34/493 |
| 2009/0094853 | A1 * | 4/2009 | Noyes et al. | 34/233 |

OTHER PUBLICATIONS

Downloaded page from www.wheatlandbins.com regarding Wheatland Hopper Bottom Bins Grain Bins "The Wheatland Advantage" (1 page) Oct. 6, 2005.

"Your Investment is Worth *Protecting" Edwards* Grain Guard, Natural Air Drying At its Best Brochure, (4 pages) Grain Guard.

* cited by examiner

GRAIN DRYING AERATION SYSTEM

BACKGROUND OF THE INVENTION

Grain bins for storing various types of grain commonly include aeration systems to enhance drying of the grain within the bin. One type of aeration system comprises a perforated floor in the bin through which air is forced. Such aeration systems dry grain from the bottom up, which often leaves the grain in the center and top of the bin damp. Another type of aeration system is one or more horizontal tubes extending through the bin with holes in the tubes to provide drying air.

Another aeration system utilizes a centrally located vertical aeration tube extending upwardly from the bottom of the bin, with holes in the cylindrical tube wall to provide drying air to the grain in the bin. Such vertical tube aeration systems are typically used in grain bins having a sloped hopper bottom with a central discharge opening with a gate moveable between open and closed positions. One type of vertical tube aeration system known as the Grain Guard Rocket has a hollow center core to increase the amount of available air flow into the grain and to reduce the obstructive nature of the unit by allowing grain to flow downwardly through the hollow center during unloading of the bin. A significant problem with vertical aeration units is structural failure during unloading of the storage bin. When hopper bottom grain bins are unloaded, the downward movement of the grain exerts high forces on all surfaces which contact the grain. Thus, an aeration unit within the grain bin must be able to resist these forces under a variety of conditions, or be subject to structural failure.

There are two types of bulk grain material flow during unloading of hopper bottom bins, either funnel flow or mass flow. In funnel flow, the grain material forms a reverse cone as it is unloading and tends to draw from the center of the bin with the particulate material falling away from the side walls of the bin, rather than sliding down the side walls. In mass flow, the grain tends to unload without forming a reverse cone in the center, and the material moves downward in the bin in a mass form that creates much greater drag on the side walls of the in. The controlling factor to determine mass flow versus funnel flow is the slope of the bottom cone of the hopper bin. With grain, funnel flow normally occurs with hopper slopes of 45° or less, while mass flow occurs with hopper slopes of 50° or more. The actual angle at which the flow changes from funnel to mass is affected by the type of stored commodity and the rate of unload.

The "Rocket" vertical aeration systems sold by Edwards Grain Guard of Alberta Canada, normally perform well when installed in a hopper bin that stores common grain commodities, such as cereal grains, and the bin unloads with funnel flow. However, the failure rate is high when vertical units are installed in a steep cone hopper bin where mass flow is present. The structural failure arises, since the inside and outside walls of the hollow vertical tube do not have sufficient strength to resist the vertical forces that are created from the boundary layer drag during unloading. While the light gauge sheet metal used in conventional vertical aeration systems may survive the vertical forces as long as the unit remains absolutely vertical, these units are also subject to relatively high horizontal and bending forces during unloading. The physical weight of the grain against the walls of the vertical tube can create deformations that destroy the vertical alignment of the light gauge walls, and significantly reduce the load carrying capacity of the tube. Then, the walls are crushed and the structure fails.

Another problem with vertical bin aeration systems is the inability to retrofit such systems into existing bins. Typically, the sheet metal walls which form the cylindrical tube are factory assembled using rivets and self-drilled sheet metal screws, which are not reasonably feasible to field assembly within a bin. Therefore, the vertical aeration system must be installed at the time of original manufacture or assembly of the grain bin.

Accordingly, a primary objective of the present invention is the provision of an improved vertical aeration system for use in a hopper bottom grain bin.

Another objective of the present invention is the provision of an improved grain bin vertical aeration system having a pyramid frame to withstand the unloading forces of grain from the bin.

A further objective of the present invention is the provision of an improved grain bin vertical aeration system having concave walls which are subject to tensile forces, rather than compression forces, during unloading of grain from the bin.

Yet another objective of the present invention is the provision of an improved vertical aeration system for bottom hopper grain bins which will withstand vertical and horizontal unloading forces.

Still another objective of the present invention is the provision of an improved vertical aeration system for grain bins which can be mounted in bottom hoppers having varying angles of slope.

Another objective of the present invention is the provision of an improved vertical aeration system for grain bins which can be retrofit into existing grain bins.

BRIEF SUMMARY OF THE INVENTION

The improved aeration system of the present invention is intended for use in a grain bin having a sloped hopper bottom. The system includes a pyramid frame including legs with lower ends attachable to the hopper bottom. Base plates are pivotally mounted to the lower end of each leg so that the frame can be secured to hopper bottoms having different slopes. A cap covers the upper ends of the legs. Concave perforated walls are attached to the legs. Braces extend between the legs to provide structural support for the concave walls. An air duct extends upwardly and centrally through the bottom of the frame to supply air to the interior of the frame for flow outwardly through the wall perforations. The unit may be three sided or four sided.

DETAILED DESCRIPTION OF THE PREFERRED EMBODIMENT

Figure 1:
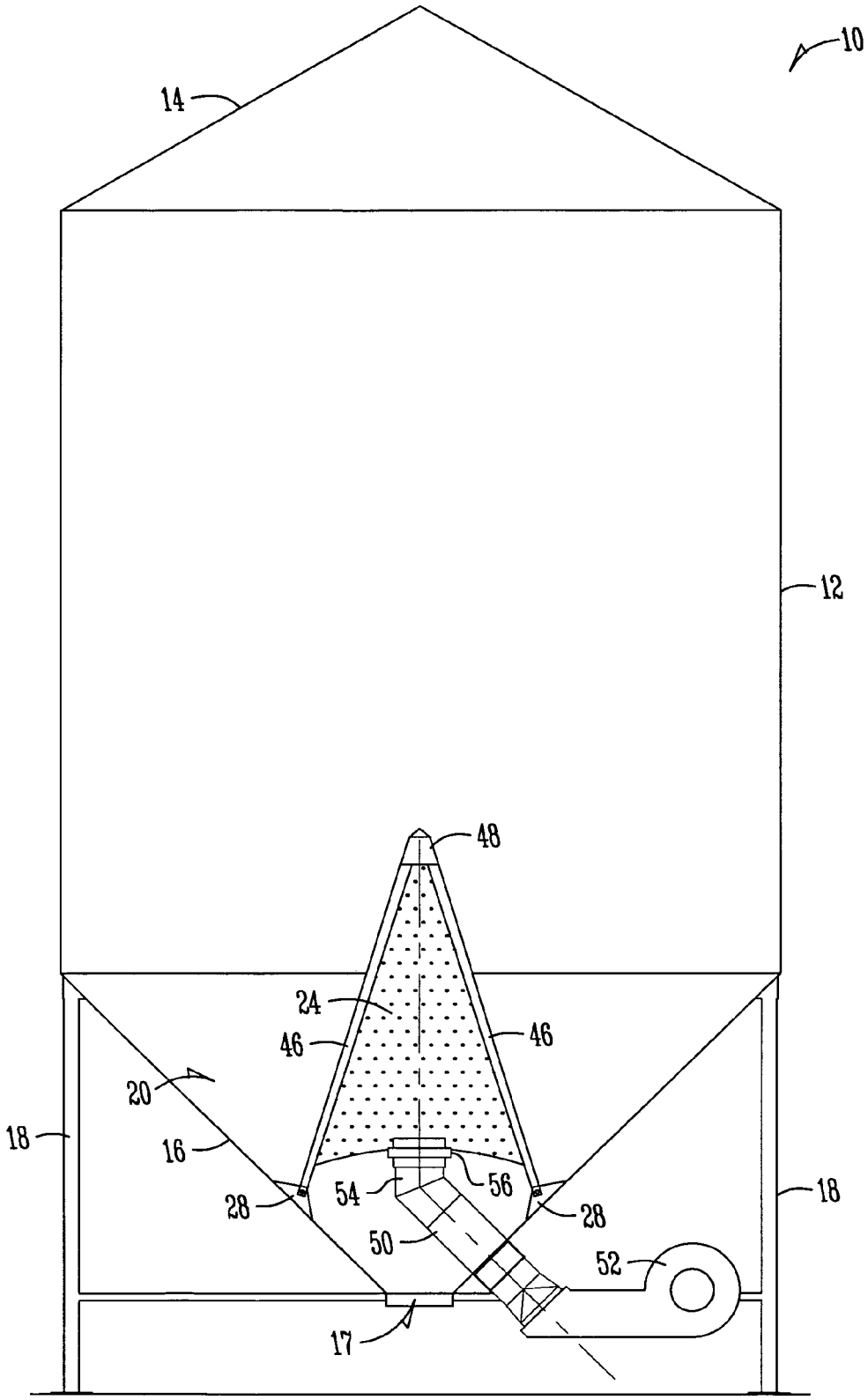
FIG. 1 is a sectional view of a hopper bottom grain bin with the vertical aeration system of the present invention mounted therein.
Figure 2:
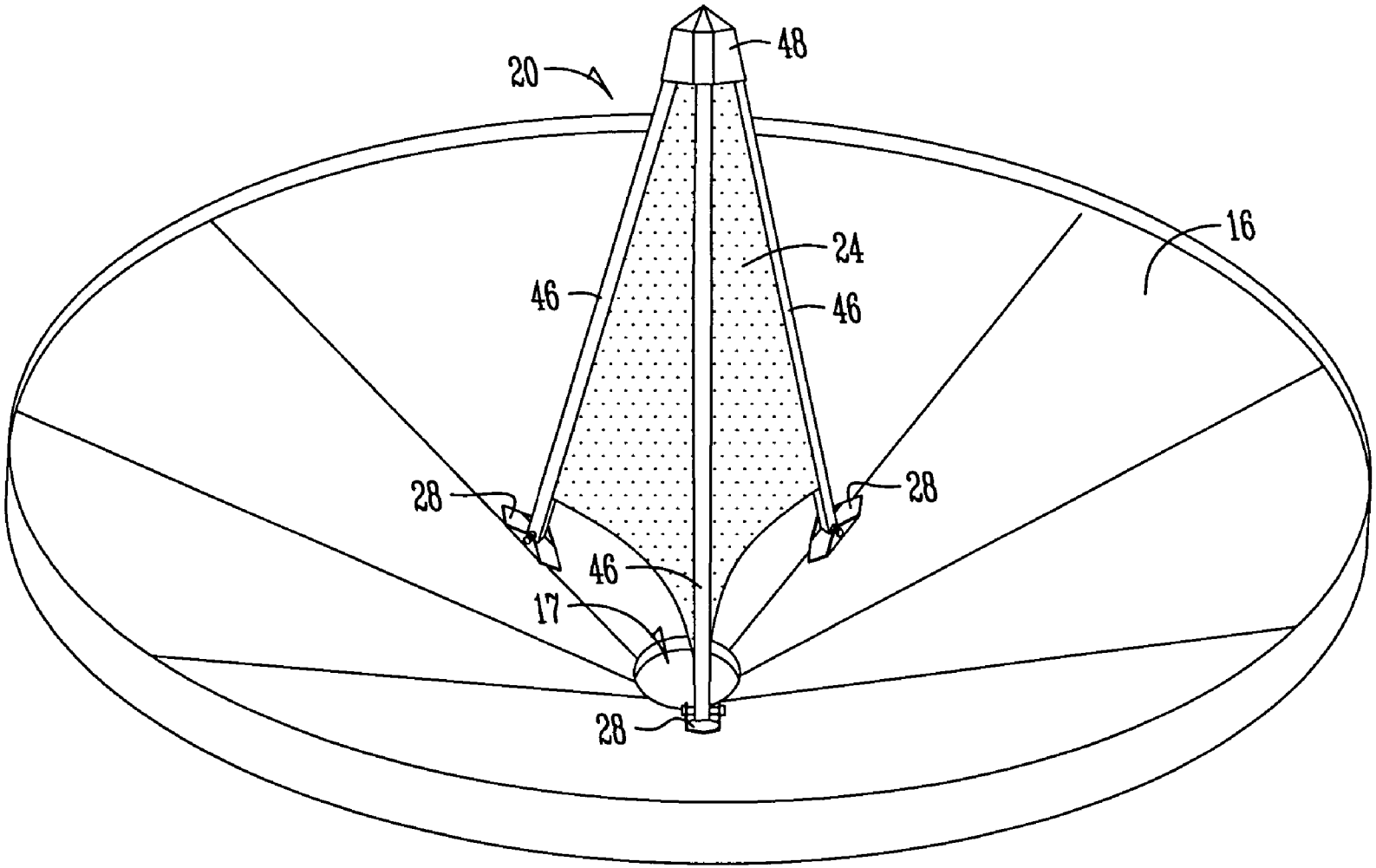
FIG. 2 is a perspective view of the aeration system mounted in the hopper bottom of the bin.

FIG. 1 shows a grain bin 10, having a side wall 12, a top 14, a bottom hopper 16 and support legs 18. The general structure of the grain bin 10 is convention, and does not constitute part of the present invention. It is understood that the slope of the bottom hopper 16 will vary from that shown in FIG. 1, for example from 40-55°. The bottom hopper 16 of the bin 10 includes a centrally disposed outlet opening 17 through which grain is discharged. A gate (not shown) is moveable between open and closed positions with respect to the outlet opening 17.

Figure 3:
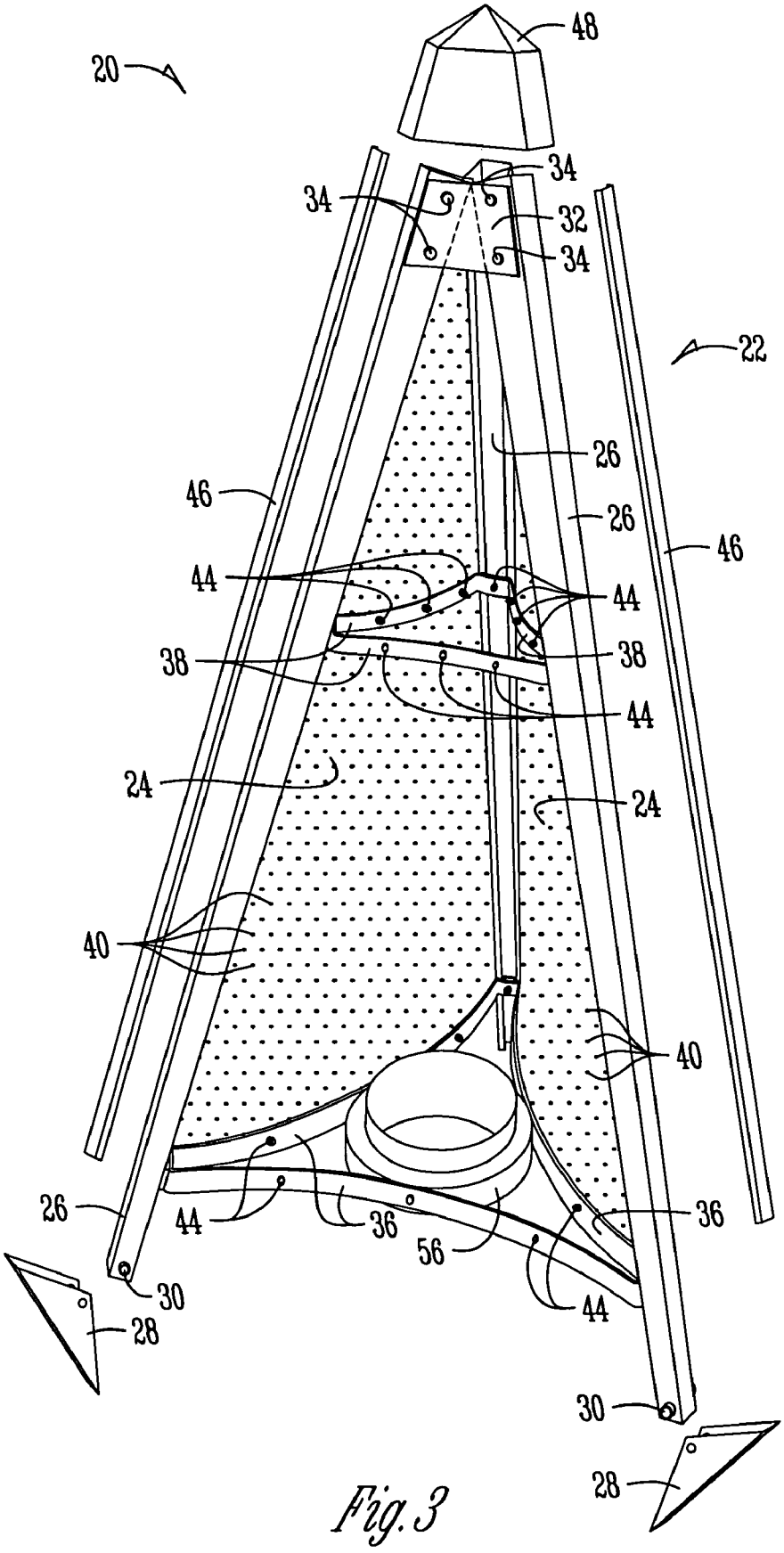
FIG. 3 is an exploded view of the aeration system of the present invention.
Figure 4:
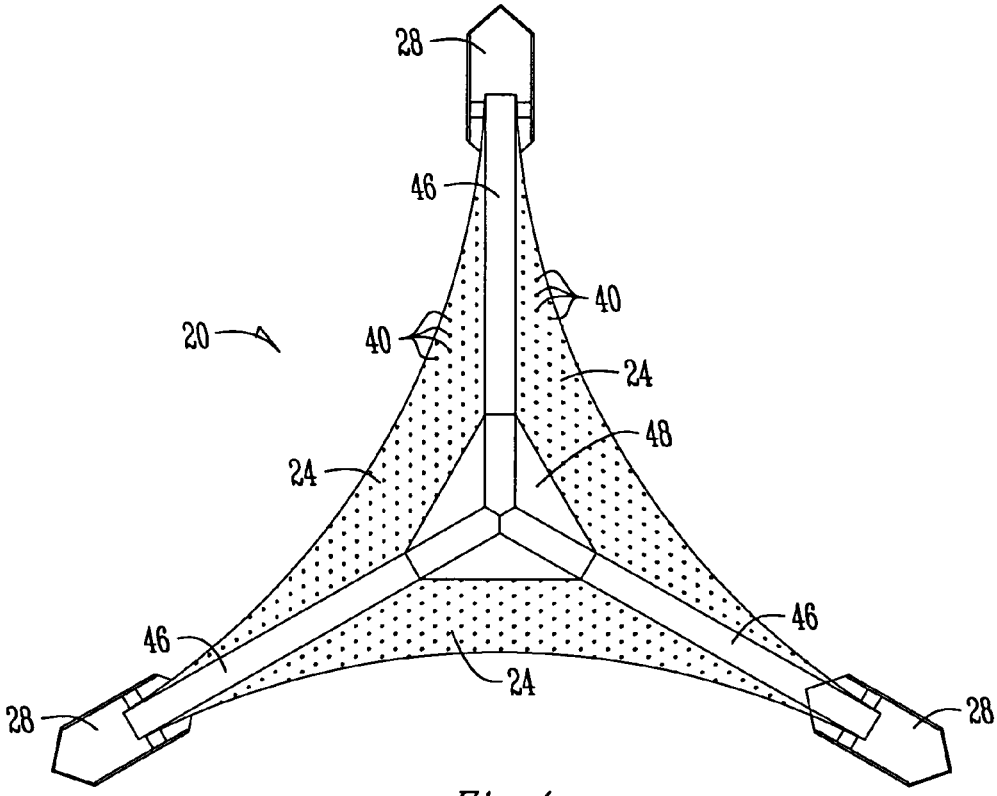
FIG. 4 is a top plan view of the aeration system of the present invention.

The present invention is directed towards an improved vertical aeration system 20 having a pyramid frame 22 and concave walls 24. FIG. 3 shows the components of the aeration system 20, with one of the walls 24 removed for clarity. The frame 24 includes legs 26 with upper and lower ends. A base plate 28 is pivotally attached to the lower end of each leg 26 using any convenient connector, such as a bolt or pin (not shown) extending through a bushing 30 on the lower ends of the legs 26. The base plates 28 are secured to the bottom hopper 16 in any convenient manner. The pivotal connection between the base plates 28 and the legs 18 allow the system 20 to be used in bins 10 wherein the bottom hopper 16 have different slopes. The upper ends of the legs 26 are connected by plates 32 using self tapping screws, bolts, or pins 34. Braces 36 are provided at the lower ends of the legs 26. One or more intermediate braces 38 may also be provided at one or more positions between the upper and lower ends of the legs 26.

The walls 24 are preferably made from sheet metal material. The walls 24 are perforated to allow air to flow outwardly through the walls. The perforations may be formed in the walls 24 in a conventional manner. The perforations may be punched holes 40 or elongated slots 42 (FIG. 5) forming downwardly disposed louvers. The walls 24 are attached to the legs 26 and/or the braces 36, 38 using self tapping screws or other connectors 44. Leg caps 46 extend over the juncture of the walls 24 and legs 26 to prevent grain from being wedged in the juncture. An upper cap 48 extends over the upper ends of the legs 26, and is secured thereto using screws or other fasteners.

Figure 5:
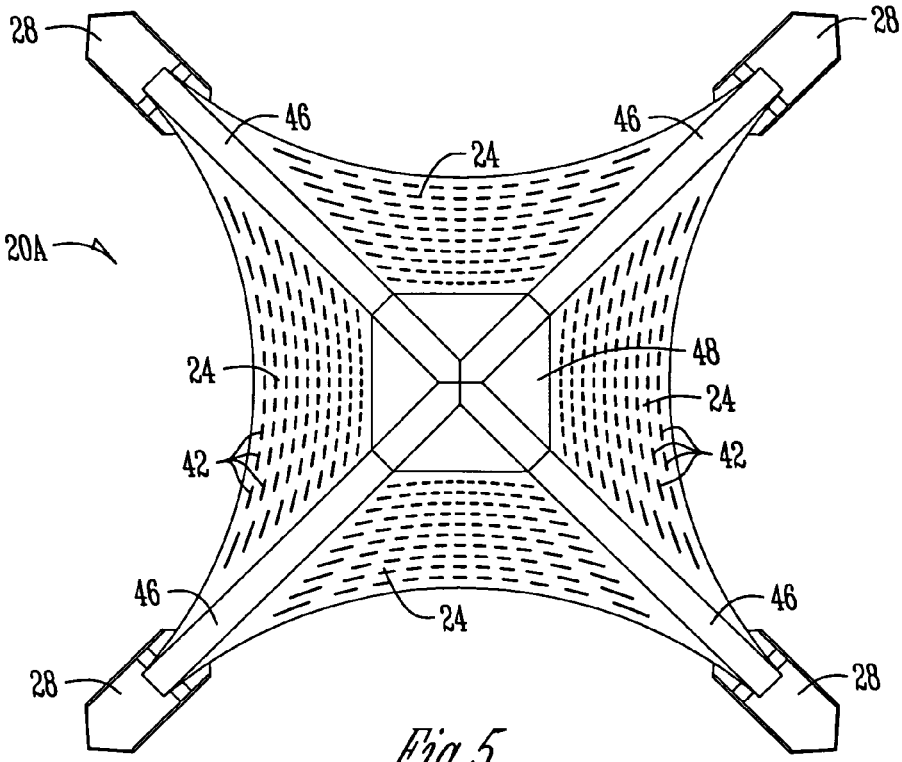
FIG. 5 is a top view of an alternative embodiment of the aeration system of the present invention.

FIGS. 1-4 show one embodiment of the aeration system 20 having three sides. FIG. 5 shows an alternative embodiment when aeration system 20A having four sides. The four-sided system 20A has the same structural components as the three sided system 20.

The aeration systems 20, 20A can be preassembled and installed in a bin 10 during construction of the bin. Alternatively, the components of the aeration systems 20, 20A can be retrofit into existing bins through conventional openings in the bin.

An air duct 50 has a lower end connected to a conventional grain bin fan 52. The upper end 54 of the duct 50 is connected to a collar 56 centrally mounted between the braces 36 in the frame 22, so as to supply air from the fan 52 to the interior of the aeration system 20, 20A. By entering the frame 24 at a central lower position, air is supplied evenly through all the walls 24 to enhance drying of grain in the bin 10.

In use, the concave walls 24 of the aeration systems 20, 20A are subjected to tensile force during unloading of grain from the bin 10, and thus will not be crushed as in prior art tubular aeration systems having cylindrical walls which are subject to compressive forces during unloading. The concave, curved surface of the walls 24 will withstand the substantial loads induced by the stored commodity, including both horizontal and vertical forces. The internal braces 36, 38 provide additional structural support for the concave walls 24. The tapered or pyramidal shape of the frame 22 minimizes the volume within the bin 10 that is displaced when the aeration systems 20, 20A are installed, and also minimizes the horizontal footprint on the bottom hopper 16 of the bin 10, thereby reducing the drag and resulting vertical forces acting on the systems 20, 20A during unloading.

The height of the aeration systems 20, 20A may vary. For example, typical heights may range between 4-10 feet, to accommodate bins having various capacities. The holes or openings 40 in the walls 24 are formed in such a way so as to minimize or prevent clogging by the grain the bin 10. The thickness of the walls 24 may vary, depending upon the bin capacity. The top cap 48 provides a small surface area so as to minimize the vertical load on the aeration systems 20, 20A.

The introduction of air through the large diameter duct 50 in a straight upward line to the bottom center of the frames 22 minimizes back pressure and delivers the maximum volume of air to the aeration systems 20, 20A. The open interior of the systems 20, 20A also allows air to be evenly distributed to the perforations 40, 42 in the walls, from bottom to top, and thereby provide more uniform drying of grain in the bin 10.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved vertical aeration system for a grain bin having a sloped hopper bottom, comprising:

a pyramid frame inside the bin and including legs with lower ends attachable to the hopper bottom and upper ends, the legs converging conically upwardly from the hopper bottom;

perforated walls attached to the legs between the upper and lower ends so as to form a perforated pyramid-shaped enclosure inside the bin and define an interior and exterior of the enclosure; and an air duct extending into the interior of the enclosure to supply air into the enclosure for flow outwardly through the wall perforations so as to dry grain in the bin.

2. The improved aeration system of claim 1 wherein the walls are concave.

3. The improved aeration system of claim 1 wherein the perforations are downwardly directed louvers.

4. The improved aeration system of claim 1 wherein the perforations are round holes.

5. The improved aeration system of claim 1 wherein the enclosure has three sides.

6. The improved aeration system of claim 1 wherein the enclosure has four sides.

7. The improved aeration system of claim 1 further comprising a base plate pivotally mounted to the lower end of each leg for securing the frame to the hopper bottom.

8. The improved aeration system of claim 1 further comprising braces extending between the legs.

9. The improved aeration system of claim 1 wherein the air duct extends upwardly between the lower ends of the legs.

10. The improved aeration system of claim 1 further comprising a cap covering the upper ends of the legs.

11. An improved grain bin for drying grain, comprising:

a grain storage container having a sloped hopper bottom;

a plurality of legs extending upwardly inside the bin with lower ends attachable to the sloped hopper bottom and upper ends;

concave walls extending between the legs to form an enclosure and define an interior and exterior of the enclosure, and having perforations therein; and an air duct to supply air to the interior of the enclosure, the air then flowing outwardly through the perforations of the walls so as to dry grain in the container.

12. The improved aeration system of claim 11 wherein the enclosure is formed as a pyramid, with the legs converging upwardly from the hopper bottom.

13. The improved aeration system of claim 11 wherein the perforations are downwardly directed louvers.

14. The improved aeration system of claim 11 wherein the perforations are round holes.

15. The improved aeration system of claim 11 wherein the enclosure has three sides.

16. The improved aeration system of claim 11 wherein the enclosure has four sides.

17. The improved aeration system of claim 11 further comprising a base plate pivotally mounted to the lower end of each leg for securing the enclosure to the hopper bottom.

18. The improved aeration system of claim 11 further comprising braces extending between the legs.

19. The improved aeration system of claim 11 wherein the air duct extends upwardly between the lower ends of the legs.

20. The improved aeration system of claim 11 further comprising a cap connected to the upper ends of the legs.

21. The improved aeration system of claim 11 wherein the legs converge conically upwardly.

* * * * *